US012006706B2

(12) United States Patent
Eleuteri

(10) Patent No.: US 12,006,706 B2
(45) Date of Patent: Jun. 11, 2024

(54) DEVICE FOR CORRECTLY LAYING FLOOR TILES

(71) Applicant: BRUNOPLAST SAS DI ELEUTERI LORENZO & C., Altidona (IT)

(72) Inventor: Bruno Eleuteri, Altidona (IT)

( * ) Notice: Subject to any disclaimer, the term of this patent is extended or adjusted under 35 U.S.C. 154(b) by 458 days.

(21) Appl. No.: 17/436,607

(22) PCT Filed: Mar. 9, 2020

(86) PCT No.: PCT/IT2020/050055
§ 371 (c)(1),
(2) Date: Sep. 5, 2021

(87) PCT Pub. No.: WO2020/188613
PCT Pub. Date: Sep. 24, 2020

(65) Prior Publication Data

US 2022/0154476 A1 May 19, 2022

(30) Foreign Application Priority Data

Mar. 19, 2019 (IT) ..... 102019000003943

(51) Int. Cl.
*E04F 21/18* (2006.01)
*E04F 15/02* (2006.01)
*E04F 21/00* (2006.01)

(52) U.S. Cl.
CPC .... *E04F 21/1877* (2013.01); *E04F 15/02022* (2013.01); *E04F 21/0092* (2013.01)

(58) Field of Classification Search
CPC ..... E04F 21/1877; E04F 15/02022; E04F 21/0092
See application file for complete search history.

(56) References Cited

U.S. PATENT DOCUMENTS

| | | | | |
|---|---|---|---|---|
| 8,635,815 | B2 * | 1/2014 | Bordin | E04F 21/0092 52/749.11 |
| 8,820,031 | B2 * | 9/2014 | Kufner | E04F 21/0092 52/749.11 |
| 9,562,365 | B2 * | 2/2017 | Bucsa | E04F 21/20 |
| 10,260,243 | B1 * | 4/2019 | Chen | E04F 21/22 |
| 10,538,925 | B2 * | 1/2020 | Ghelfi | E04F 13/0892 |
| 11,428,019 | B2 * | 8/2022 | Sighinolfi | E04F 21/0092 |
| 2019/0271167 | A1 * | 9/2019 | Ghelfi | E04F 21/0092 |
| 2022/0154476 | A1 * | 5/2022 | Eleuteri | E04F 15/02022 |

FOREIGN PATENT DOCUMENTS

| | | | | |
|---|---|---|---|---|
| EP | 2549030 | A2 * | 1/2013 | E04F 21/0092 |
| EP | 2921609 | A1 | 9/2015 | |
| JP | 3773217 | B2 | 5/2006 | |

OTHER PUBLICATIONS

ISR: European Patent Office; May 19, 2020.

* cited by examiner

*Primary Examiner* — Yaritza Guadalupe-McCall
(74) *Attorney, Agent, or Firm* — Patshegen IP; Moshe Pinchas

(57) ABSTRACT

A knob (1), for correctly laying tiles, comprises a first jaw (10) and a second jaw (20) which are connected to each other in such a way that said knob (1) can adopt a clamped configuration, in which the first and the second jaw (10,20) are in contact with each other, and a wide apart configuration, in which the first and the second jaw (10,20) are not in contact with each other.

8 Claims, 6 Drawing Sheets

DEVICE FOR CORRECTLY LAYING FLOOR TILES

TECHNICAL FIELD

This patent application for an industrial invention relates to a device for correctly laying floor tiles.

BACKGROUND ART

As it is known, floors, or coverings in general, formed of a plurality of ceramic tiles, are still widespread.

When preparing such floored surfaces, one important requirement which arises is that of making the floor perfectly planar while laying it.

Naturally, such a condition can only be guaranteed if the upper surface of each tile adopts a configuration perfectly coplanar with the configuration adopted by the upper surface of all of the other tiles of the same floor.

In order to guarantee the layer greater fitting precision and a faster speed of execution, already some time ago several "alignment" devices were produced, called, in slang, levellers, which are intended precisely to be used for laying various adjacent rows of tiles.

A type of such prior art levellers, already known from EP 2921609, comprise a strap and a knob which is suitable for operating in conjunction with the strap. The strap comprises a base plate, intended to be positioned on a sub-floor or on a wall, below two or more adjacent tiles, and a vertical thin plate, jutting centrally from the base plate in such a way as to be positioned in a space obtained between said two or more adjacent tiles. That vertical thin plate ends at the top with a threaded rod and is connected at the bottom to the base plate by means of a lower end with reduced cross-section, suitable for being cut at the moment when the threaded rod, once the tiles are stably fixed, is subjected to pulling/bending stresses.

The knob comprises a flange, which surrounds the base of the knob and which is intended to be abutted on top of the tiles, and a body, jutting above the flange, which consists of a cylindrical cover equipped, starting from its upper closing wall, with a central cylindrical duct, with threaded inner walls, suitable for precisely receiving and with it creating a helical coupling, the threaded rod provided at the top of the strap.

In the case in question, the operator, in order to fit the knob on the strap, must screw the knob onto the threaded rod of the strap, until the flange of the knob is moved into contact with the tiles and applies pressure on the tiles.

In the same way, in order to remove the knob from the strap, the operator must unscrew the knob from the threaded rod of the strap, until they are completely uncoupled.

It is evident that such operations, which must be performed for each leveller, are lengthy, complex and not very practical.

Document JP 3773217 discloses a connection between two jaws of semi-cylindrical shape which can be freely switched between an open or closed position by rotating around a cylindrical hinge. The looking condition of the jaws is obtained by means of a bolted connection.

DISCLOSURE OF THE INVENTION

The aim of this invention is to overcome the disadvantages of the prior art by providing a knob which can be fitted on a strap in a simple, rapid and practical way, in order to align two or more tiles of a floor.

Another aim of this invention is that of devising a device which allows the correct alignment of two or more tiles in a simple, rapid and practical way.

These aims are achieved in accordance with the invention with the features listed in the appended independent claim 1.

Advantageous embodiments appear from the independent claims.

The knob according to the invention is defined by claim 1.

In particular, said knob is characterised in that it comprises a pair of jaws, hinged to each other, which are suitable for defining, in conjunction with each other, a threaded duct suitable for engaging with the threaded rod of the strap.

The advantages of the knob according to the invention appear to be evident, wherein providing two jaws, which are hinged to each other, ensures that the knob can be fastened to and released from the threaded rod of the strap in a simple and rapid way, without having to screw and unscrew the knob, thereby reducing tile laying times.

BRIEF DESCRIPTION OF DRAWINGS

For a clearer explanation the description of the invention continues with reference to the appended drawing plates, which are provided by way of illustration only and do not limit the scope of the invention, wherein.

BEST EMBODIMENT OF THE INVENTION

Figure 1:
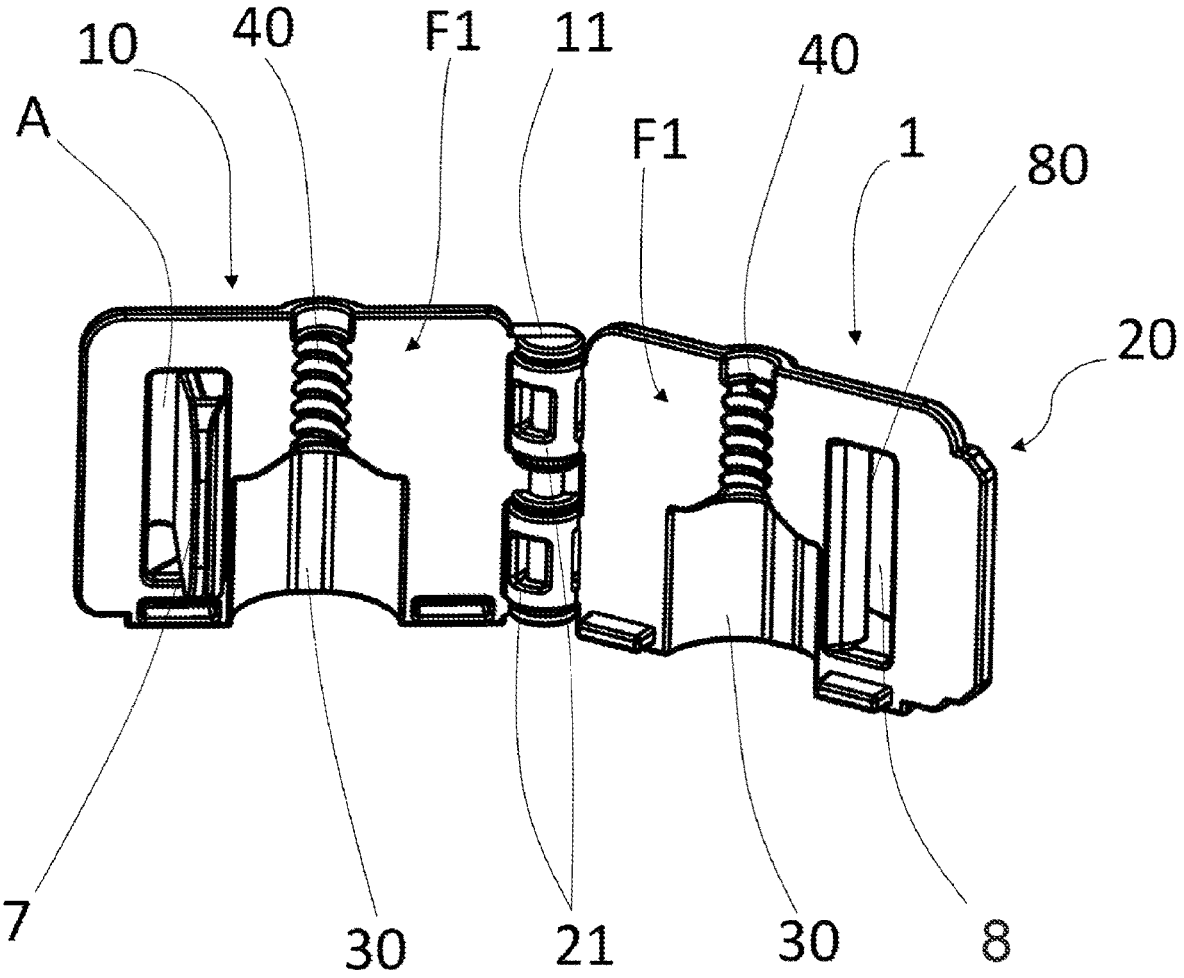
FIG. 1 is an axonometric view of a knob according to the invention, in a wide apart configuration.
Figure 2:
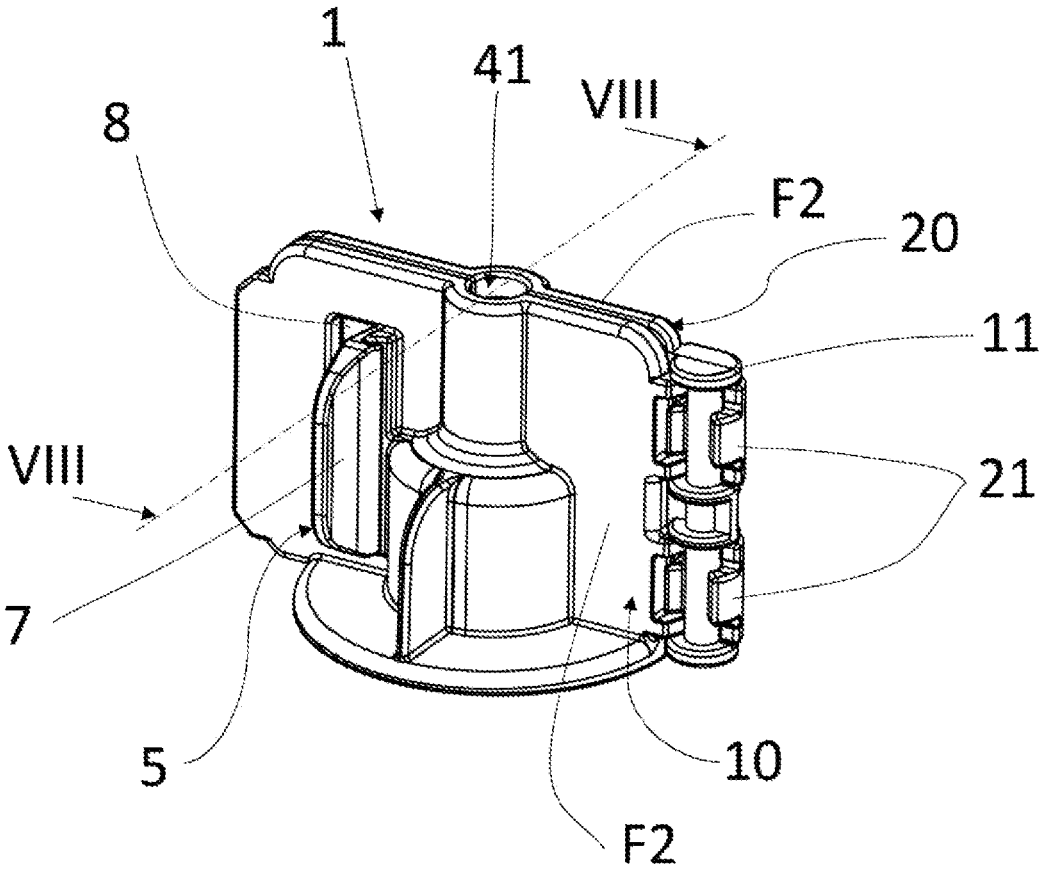
FIG. 2 is an axonometric view of the knob according to the invention, in a clamped configuration.
Figure 3:
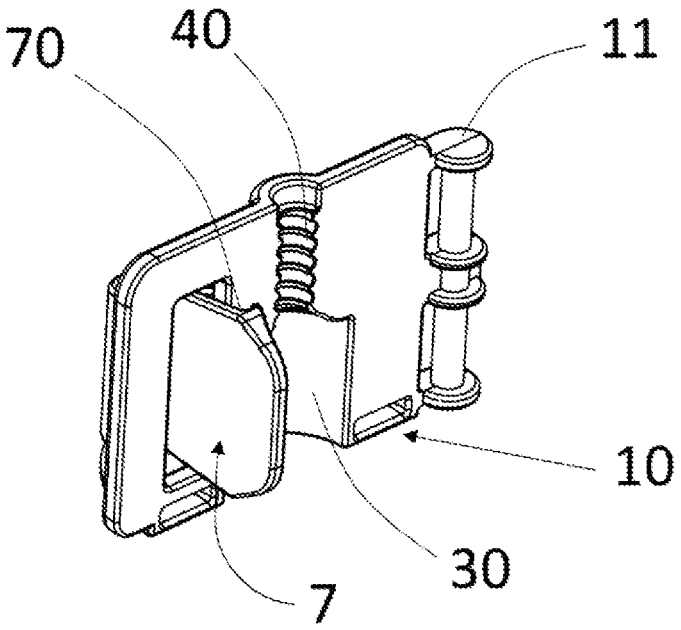
FIG. 3 is an axonometric view of a first jaw of the knob according to the invention.

With reference to FIGS. 1 and 2, a knob according to the invention is described, labelled in its entirely with the reference number (1).

The knob (1) is intended to be used for correctly laying tiles of a floor and is shaped in such a way as to operate in conjunction with a strap (B).

Figure 9:
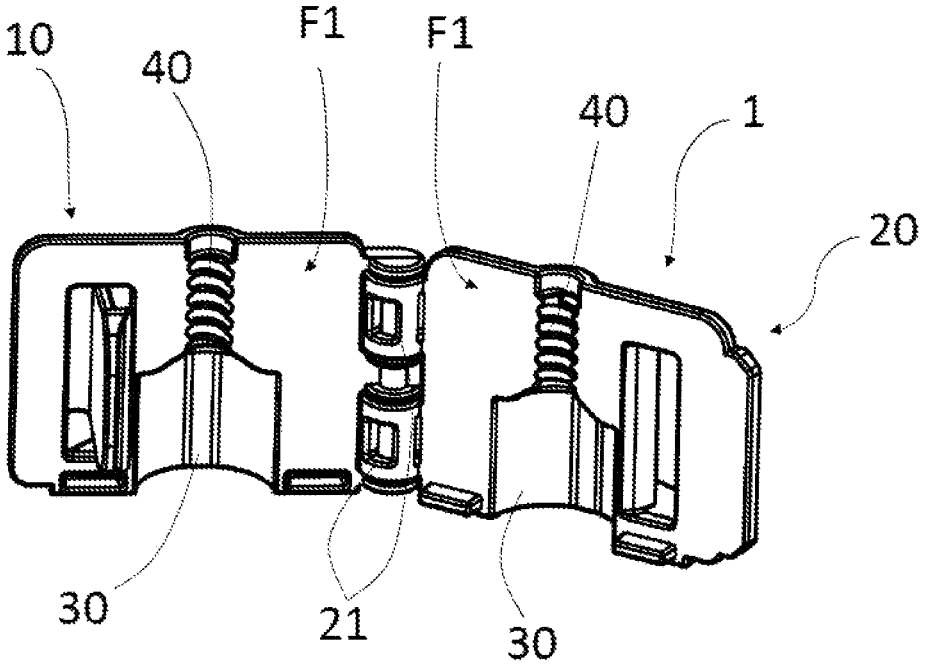
FIG. 9 is an axonometric view of the device according to the invention, in a disassembled configuration.
Figure 9:
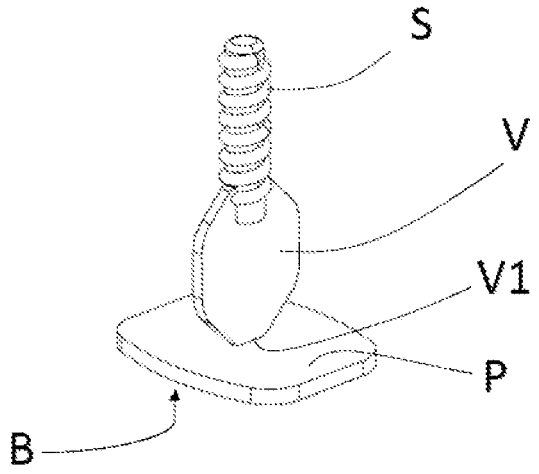

With reference to FIG. 9, the strap (B) is of the prior art type and comprises a base plate (P), intended to be positioned on a sub-floor or on a wall, below two or more adjacent tiles, and a vertical thin plate (V), jutting centrally from the base plate (P) in such a way as to be positioned in a space obtained between said two or more adjacent tiles. That vertical thin plate (V) of the strap ends at the top with a threaded rod (S) and is connected at the bottom to the base plate (P) by means of a breakable lower end (V1) with reduced cross-section.

There is nothing to prevent the threaded rod (S) from jutting directly from the base plate (P) of the strap, without said thin plate (V) being interposed between them.

Returning to FIGS. 1 and 2, the knob (1) comprises a first jaw (10) and a second jaw (20).

In particular with reference to FIG. 1, each jaw (10,20) has a monolithic structure made by moulding plastic materials and comprises an inner face (FI), intended to be directed towards the threaded rod (S) of the strap (B), and an outer face (F2), opposite to the inner face (FI) and intended to be directed towards the outside.

Each jaw (10,20) comprises a half-seat (30) and a threaded half-duct (40), both made on the inner face (FI) of the jaw (10,20).

The first and the second jaw (10,20) of the knob are connected to each other in such a way that the knob (1) can adopt a clamped configuration (shown in FIG. 2), in which the inner faces (FI) of the first and of the second jaw (10,20) are in contact with each other, and a wide apart configuration (shown in FIG. 1), in which the inner faces (FI) of the first and of the second jaw (10,20) are not in contact with each other.

Figure 8:
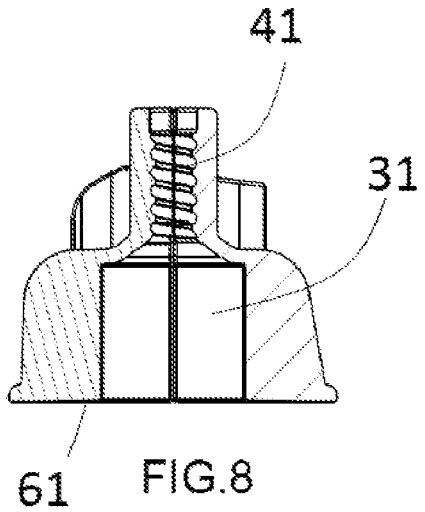
FIG. 8 is a cross-section view of the knob of FIG. 2, seen along the cross-section plane VIII-VIII of FIG. 2.

In particular with reference to FIG. 8, when the knob (1) is in the clamped configuration, the two half-seats (30) and the two half-ducts (40) of the two jaws respectively form a cylindrical seat (31), intended to house the vertical thin plate (V) of the strap, and a threaded duct (41), intended to house the threaded rod (S) of the strap.

Obviously, when the thin plate (V) has a width greater than the diameter of the threaded rod (S), then the width of the cylindrical seat (31) is also greater than the diameter of the threaded duct (41).

It is also evident that, were a strap (B) without the thin plate to be used, that is to say, with the threaded rod (S) attached directly to the base plate (P), then the knob (1) would be provided with only the threaded duct (41).

Advantageously, the threaded duct (41) formed by the two half-ducts (40) has a thread with rounded edges. In that way, when closing the knob (1) on the threaded rod (S) of the strap, if the crest of a thread of the threaded rod (S) were to make contact with the crest of a thread of the threaded duct (41) of the knob, the rounded edges of the thread of the threaded duct (41) of the knob would cause a small sliding of the knob along the threaded rod (S) of the strap, in such a way that the threads of the threaded rod (S) engage precisely with the threads of the threaded duct (41) of the knob.

Returning to FIGS. 1 and 2, the first and the second jaw (10,20) of the knob (1) are hinged to each other. More precisely, the first jaw (10) comprises a pin (11) and the second jaw (20) comprises two open sleeves (21) which house the pin (11).

Figure 5:
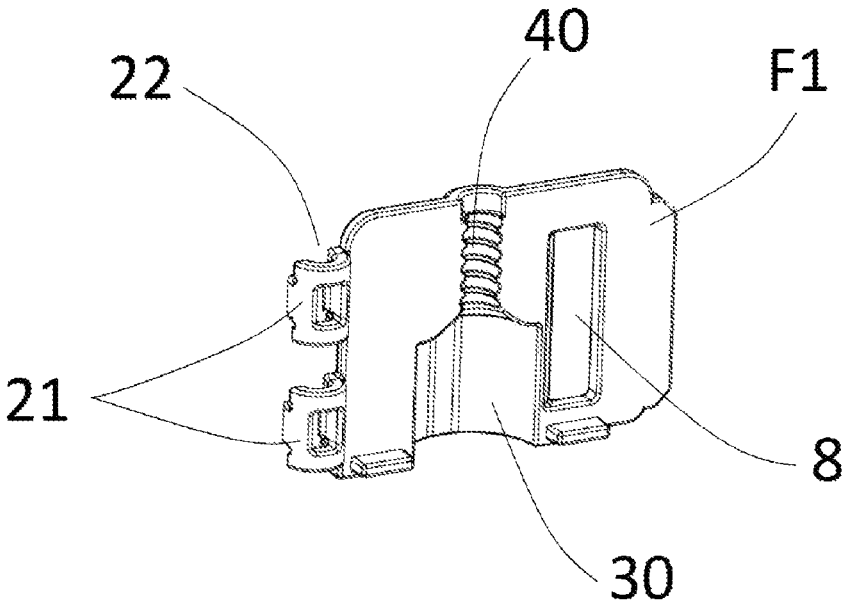
FIG. 5 is an axonometric view of a second jaw of the knob according to the invention.
Figure 6:
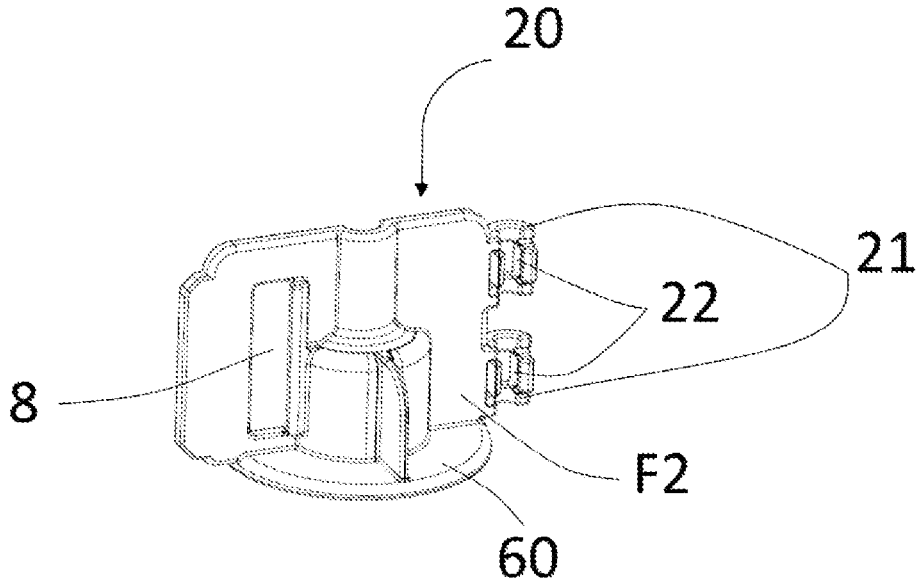
FIG. 6 is similar to FIG. 5, but shows the second jaw of the knob from another angle.

In particular with reference to FIGS. 5 and 6, each sleeve (21) of the second jaw (20) comprises a radial opening (22) directed towards the outer face (F2) of the second jaw (20), that is to say, directed towards an opposite side of the second jaw (20) relative to the half-duct (40) and the half-seat (30) of the second jaw (20).

Alternatively, both of the jaws (10, 20) may comprise closed sleeves (21), intended to house an external pivot pin.

Alternatively, the first and the second jaw (10,20) could be connected to each other by means of a flexible thinned portion, made of plastic material, that is to say, the knob (1) could be monolithic and made, in a single piece, by moulding plastic material.

The knob (1) comprises closing means (5) for keeping the knob (1) in the clamped configuration.

In particular with reference to FIGS. 3, 5, 7 and 7A, those closing means (5) are of the latch type and comprise an elastic latch (7) connected to the first jaw (1) and shaped in such a way as to be inserted, with an elastic snap-in action, into a slot (8) purpose-made on the second jaw (2).

The latch (7) comprises a wedge (70) and a flexible tongue (71) which connects the wedge (70) to the first jaw (10). In particular, the first jaw (10) comprises a window (A) (shown in FIGS. 1 and 4) and the flexible tongue (71) of the latch (7) has a "U"-shape, comprising:

- a straight first portion (T1) connected to the outer face (F2) of the first jaw (10),
- a curved connecting portion (T2), with concavity directed towards the window (A) of the first jaw (10), and
- a straight second portion (T3), parallel to the straight first portion (T1), having a first end connected to the straight first portion (T1), by means of the curved connecting portion (T2), and a second end comprising the above-mentioned wedge (70).

The straight second portion (T3) of the flexible tongue of the latch (7) passes through the window (A) of the first jaw (IO), in such a way that the wedge (70) projects from the inner face (FI) of the first jaw (10).

The slot (8) made in the second jaw (20) is delimited by an enlarged edge (80) having an inner surface (81) inclined outwards, in such a way as to act as a guide for insertion of the wedge (70) of the latch (7) into the slot (8). The enlarged edge (80) comprises an outer surface (82) having a rib (9) which acts as a locking surface for the latch (7) inserted into the slot (8). The wedge (70) of the latch has an inclined wall suitable for sliding on the inner surface (81) of the enlarged edge delimiting the slot (8).

As long as the wedge (70) slides on the inner surface (81) of the enlarged edge delimiting the slot (8), the flexible tongue (71) of the latch is subject to gradual elastic bending, thanks to which the flexible tongue (71) itself is released, to adopt its home configuration again, as soon as there is an end to the interference between the wedge (70) and the inner surface (81) of the enlarged edge delimiting the slot (8).

The wedge (70) of the latch (7) also comprises a groove (72) suitable for housing the rib (9) of the enlarged edge delimiting the slot (8), when the knob (1) is in the clamped configuration.

Figure 4:
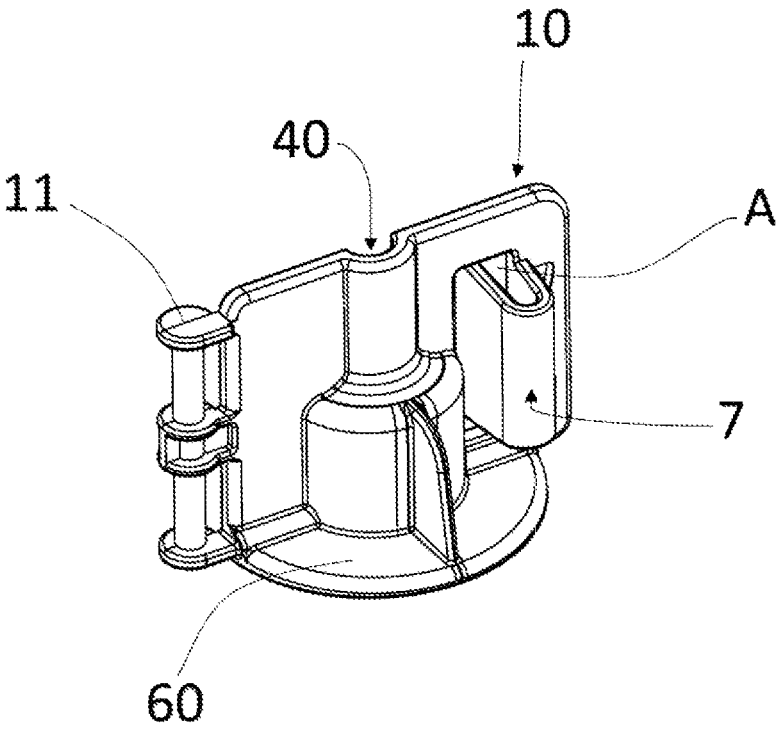
FIG. 4 is similar to FIG. 3, but shows the first jaw of the knob from another angle.
Figure 7:
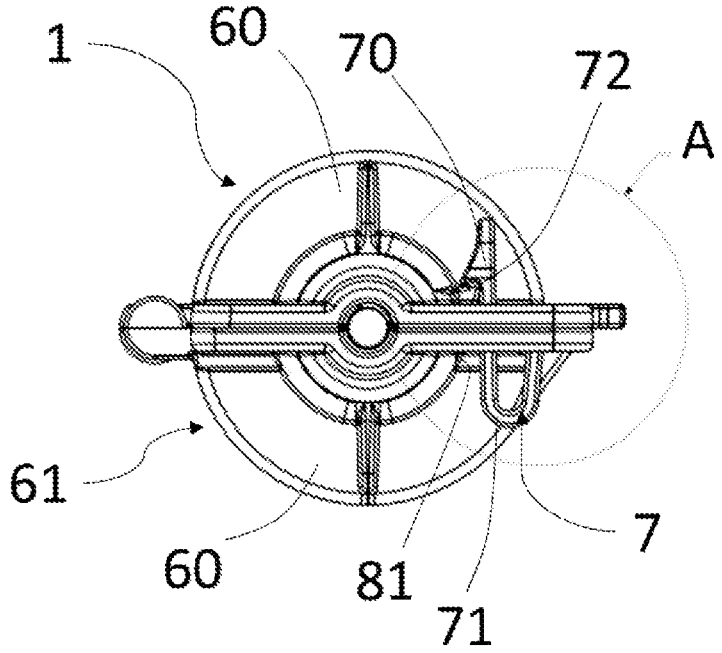
FIG. 7 is a top view of the knob according to the invention, in a clamped configuration.
Figure 7A:
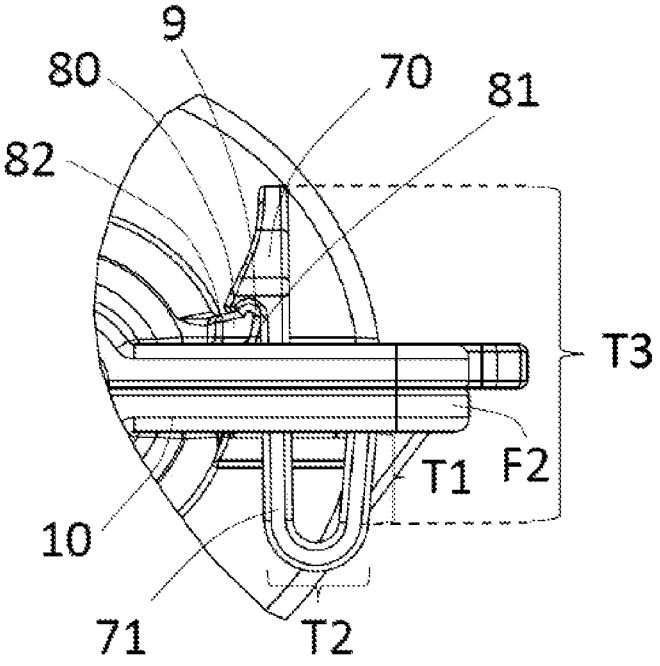
FIG. 7A is an enlarged view of the detail contained in the circle A of FIG. 7.

With reference to FIGS. 4, 6 and 7, each jaw (10, 20) comprises a semi-annular flange (60) projecting outwards from the outer face (F2) of the jaw (10, 20), that is to say, projecting on an opposite side of the jaw (10, 20) relative to the half-duct (40) and the half-seat (30) of the jaw.

Those base semi-annular flanges (60) of the jaws (10, 20) are intended to be positioned on top of the adjacent tiles and form a single annular flange (61), when the knob (1) is in the clamped configuration (as shown in FIG. 7).

Each semi-annular flange (60) has a lower surface which is inclined, so that it is sloping outwards, as shown in FIG. 8.

With regard to this it should be noticed that, during the step of clamping knob (1) on the threaded rod (S) of the strap, a stress state is generated which tends to force apart the two jaws (10, 20) of the knob.

Therefore, precisely in order to counter that phenomenon, the device of giving each semi-annular flange (60) the above-mentioned inclination was adopted, so that the lower surface of the flange (61) does not lie in a horizontal plane, but instead has the above-mentioned double inclination.

In that way, during screwing of the knob (1) onto the threaded rod (S) of the strap, the peripheral edge of the flange (61) is the first to intercept the upper surface of the tiles.

That means that, during the gradual screwing of the knob (1) against the tiles below, as a reaction, a peripheral thrust is generated which pushes the two semi-annular flanges (60) upwards, generating a bending moment which pushes the two jaws (10, 20) against each other, during screwing of the knob.

The description continues with reference to the method for aligning tiles by means of the device according to the invention.

The base plate (P) of the strap is positioned on a sub-floor or on a wall which is coated with adhesive, and two or more tiles are positioned, adjacent to each other, on said base plate (P), in such a way that the vertical thin plate (V) of the strap projects from a space obtained between said two or more adjacent tiles.

The knob (1), in the wide apart configuration, is clamped on the threaded rod (S) of the strap, in such a way that the threaded rod (S), along almost its whole length, is accommodated inside the threaded duct (41) of the knob.

In other words, during this step of clamping the two jaws (10, 20), the relative semi-annular flanges (60) brush against the upper surface of the tiles.

Then, the latch (7) of the first jaw (10) is pushed into the respective slot (8) made in the second jaw (20), so as to cause the two jaws (10,20) to be fastened to each other, which corresponds to a simultaneous insertion of the threaded rod (S) into the threaded duct (41) of the knob.

At this point, the operator rotates the knob (1), so as to cause its screwing onto the threaded rod (S) of the strap, which ends at the moment when the flange (61) of the knob abuts, with force, on top of the tiles.

It is during this step that the advantage of the invention is appreciated, since a rotation of the knob (1), even by less than one turn, will be sufficient to reach the screwing end of stroke.

Once the tiles are fixed to the sub-floor or to the wall, the operator can remove the knob (1) from the strap by simply opening the jaws (10,20), by acting on the flexible tongue (71) of the latch, in order to free the latch (7) from its gripping slot (8).

The final operation, which is completely conventional, is that of stressing the threaded rod (S) of the strap in order to cause the vertical thin plate (V) to be torn from the base plate (P) of the strap, whilst said strap remains disposable, trapped under the tiles.

Thanks to the fact that two jaws (10,20) hinged to each other are provided, the knob (1) can be fastened to and released from the thin plate of the strap easily and rapidly, without having to screw the knob onto and unscrew it from the whole length of the threaded rod (S) of the strap, meaning that it speeds up the tile laying times.

The invention claimed is:

1. Knob (1), for correctly laying tiles, comprising a first jaw (10) and a second jaw (20), each jaw (10,20) delimiting a half-seat (30) and a threaded half-duct (40); wherein the first and the second jaw (10,20) are connected to each other in such a way that said knob (1) can adopt a clamped configuration, in which the first and the second jaw (10,20) are in contact with each other and the two half-seats (30) and the two half-ducts (40) respectively form a cylindrical seat (31) and a threaded duct (41), which is intended to house a threaded rod (S) of a strap (B); and a wide apart configuration, in which the first and the second jaw (10,20) are not in contact with each other;

said knob (1) comprising closing means (5) for keeping the knob (1) in the clamped configuration and characterising in that said closing means (5) are of the latch type wherein one of said two jaws (10,20) comprises an elastic latch (7) and the other jaw (10,20) comprises a slot (8) suitable for housing the latch (7) with an elastic snap-in action.

2. Knob (1) according to claim 1, wherein each jaw (10,20) comprises a base semi-annular flange (60), projecting from an opposite side of the jaw (10,20) relative to the half-duct (40) and the half-seat (30) of the jaw; said base semi-annular flanges (60), of the jaws (10,20) being suitable for being positioned on said two adjacent tiles and for forming an annular flange (61) when the knob (1) is in the clamped configuration.

3. Knob (1) according to claim 2, wherein each semi-annular flange (60) has a lower surface which is inclined, so that it is sloping outwards.

4. Knob (1) according to claim 1, wherein said first and second jaw (10,20) are hinged to each other.

5. Knob (1) according to claim 4, wherein the first jaw (10) comprises a pin (11) and the second jaw (20) comprises at least one open sleeve (21), housing said pin (11).

6. Knob (1) according to claim 5, wherein said sleeve (21) of the second jaw (20) comprises a radial opening (22) directed towards an opposite side of the second jaw (20) relative to the half-duct (40) and to the half-seat (30) of the second jaw (20).

7. Knob (1) according to claim 1, wherein the threaded duct (41) formed by the two half-ducts (40) has a thread with rounded edges.

8. Device (100), for correctly laying tiles, comprising a strap (B) which includes a base plate (P), lying in a horizontal plane, which is intended to be positioned on a sub-floor or on a wall, below two or more adjacent tiles, and a vertical threaded rod (S), which is connected directly, or by means of a vertical thin plate (V), to the base plate (P); and a knob (1) according to claim 1.

* * * * *